US007563057B2

(12) United States Patent
Sine

(10) Patent No.: US 7,563,057 B2
(45) Date of Patent: Jul. 21, 2009

(54) EARTHEN CONTAINMENT REINFORCEMENT SYSTEM

(76) Inventor: Richard Sine, P.O. Box 7188, Brookings, OR (US) 97415

( * ) Notice: Subject to any disclaimer, the term of this patent is extended or adjusted under 35 U.S.C. 154(b) by 285 days.

(21) Appl. No.: 11/730,872

(22) Filed: Apr. 4, 2007

(65) Prior Publication Data

US 2008/0247829 A1 Oct. 9, 2008

(51) Int. Cl.
*E02D 29/00* (2006.01)

(52) U.S. Cl. ..... 405/284; 405/286

(58) Field of Classification Search ..... 405/262, 405/284, 285, 286, 287
See application file for complete search history.

(56) References Cited

U.S. PATENT DOCUMENTS

| | | | | |
|---|---|---|---|---|
| 1,095,249 | A | | 5/1914 | Waddill |
| 1,812,364 | A | * | 6/1931 | Oursler ..... 405/287 |
| 1,885,470 | A | | 1/1932 | Noetzli |
| 1,879,430 | A | | 9/1932 | Noetzli |
| 1,988,777 | A | | 1/1935 | Bohrisch |
| 1,997,132 | A | | 4/1935 | Collorio |
| 2,863,291 | A | | 12/1958 | Murmann |
| 3,188,814 | A | | 6/1965 | Rettig |
| 4,090,363 | A | | 5/1978 | List et al. |
| 4,659,252 | A | | 4/1987 | Sexton et al. |
| 4,832,528 | A | | 5/1989 | Lisart |
| 5,114,270 | A | | 5/1992 | Riddle |
| 6,588,979 | B1 | | 7/2003 | Pasij |

* cited by examiner

*Primary Examiner*—David J Bagnell
*Assistant Examiner*—Benjamin Fiorello

(57) ABSTRACT

An earthen containment reinforcement system has a plurality of connected panels containing recycled rubber vehicle tire material forming a retaining or barrier wall. The panels are connected by interlocking joints, and secured by a reinforcing cable that traverses the length of the connected panels. For added structural integrity, the reinforcing cable is connected by a plurality of tether cables to a corresponding plurality of anchors that are sunken in the earthen containment. An erosion shield is connected to the top edge of the retaining wall, and extends away from the top of the wall toward a land side of the earthen containment that is opposite the water side. By virtue of their construction from recycled vehicle rubber tire material, the panels are not only impervious to water and burrowing rodents and resistant to erosion, earth tremor, and explosion, but are easy and economical to fabricate and maintain.

20 Claims, 18 Drawing Sheets

120
Main Line 130
120
Cross Anchor Support
115
110

EARTHEN CONTAINMENT REINFORCEMENT SYSTEM

BACKGROUND OF THE INVENTION

1. Field of the Invention

The present invention relates generally to a system for reinforcing an earthen containment that retains a body of water. More particularly, the present invention relates to an earthen containment reinforcement system that has a plurality of interconnected, molded panels constructed of recycled rubber vehicle tire material.

2. Description of the Prior Art

Devices are generally known for reinforcing earthen containments such as levees, dikes, dams and the like. One problem associated with such earthen containments, however, is that the reinforcements do not respond satisfactorily to motion of the containment as the retained water level changes. U.S. Pat. No. 1,997,132 addresses this issue by disclosing a reinforcement or core that is incorporated in an earthen dam. The core consists of two or more tight elastic walls, with the space between two adjacent walls being occupied by a permeable filler. As the retained water level varies, the elastic walls can follow the motion of the earthen dam.

To provide a more secure reinforcement, U.S. Pat. No. 4,090,363 discloses an impervious core of plate-shaped wall sections made of a poured soil-concrete mixture. To construct the core, particulate fill is deposited on a foundation impervious to water. A trench is excavated in the fill to the foundation, and plate-shaped wall sections are sequentially built in the trench. Each wall section is built by pouring an aqueous slurry into the trench, the solids in the slurry consisting essentially of particulate filler material and an amount of Portland cement sufficient to cause solidification of the slurry. The slurry intended to constitute the lowermost wall section is poured on the foundation, and each subsequent section is poured on the top edge portion of a previously poured and solidified section.

In another approach to reinforcing an earthen containment, U.S. Pat. No. 1,095,249 discloses a reinforcement in the form of a plurality of vertically disposed panels in an earthen dam. Each panel is provided with a tongue and groove so that adjacent vertical panels are rigidly interconnected to form a continuous wall that extends vertically through the dam or levee.

Another susceptibility of earthen containments is that their surfaces are subject to erosion by the retained water. To counteract this erosion, U.S. Pat. Nos. 1,885,470, 1,879,430 and 4,832,528 disclose panels that cover the surface of the earthen dam that faces the retained water.

The aforementioned prior art reinforcement systems suffer from various drawbacks, however, including the cost of constructing and maintaining the reinforcement, susceptibility of the overlying surface soil to erosion, and compromise of the waterproof integrity by boring and burrowing animals. Another problem is that vertical reinforcing structures that are buried within the earthen containment can be compromised, and in the absence of an associated anchor to support them, can fail along with remainder of the earthen containment. Failure can also arise from shock to the containment by movement of the surrounding soil as a result of earthquakes or explosions.

Another specific vulnerability associated with the earthen containments is overtopping, in which any release of retained water over the top of the containment can compromise its integrity by washing away soil from the downstream slope of the dam, or in the case of a levee, the landslide of the containment.

The prior art does not disclose, therefore, a system for reinforcing earthen containments that is not only effective and secure, but that is economical to fabricate and maintain. The prior art also does not disclose a structure that prevents erosion of soil from the downstream slope of the dam during overtopping.

SUMMARY OF THE INVENTION

In order to overcome the above-described drawbacks of the prior art, the present invention provides an earthen containment reinforcement system that strengthens and maintains the integrity of earthen levees, dikes, dams or the like which are used to retain bodies of water. The earthen containment reinforcement system of the present invention includes a series of panels that interconnect end-to-end and/or top-to-bottom to form a watertight retaining wall within the core of the earthen levee, dike, or dam (hereinafter referred to as an "earthen containment"). The panels are constructed of recycled vehicle rubber tire material including steel rim beads and rubber crumb. The assembly of the panels into the retaining wall prevents seepage and percolation, making the wall impervious to erosion, rodent burrowing, and tremor due to earthquake or explosion, and thus ensuring the structural integrity of the earthen containment.

The disposal of used vehicle tires is problematic. Thus, such tires for useful applications are readily available. It is, therefore, an object of the present invention to provide a system that reinforces an earthen containment by using readily available used vehicle tires, preferably used automobile tires.

According to a preferred embodiment of the invention, the earthen containment reinforcement system includes a retaining wall formed from a plurality of interconnected, pre-fabricated panels containing recycled rubber tire material, including recycled tire crumb and reinforcing steel tire beads. The pre-fabricated panels are designed to interconnect top-to-bottom and end-to-end to form a waterproof reinforcement and barrier wall along the longitudinal core of the earthen containment. This barrier wall prevents seepage and percolation of the soil bank, preventing erosion and structural failure of the earthen containment. A polyurethane-based adhesive is applied to the joints of the connected panels to provide a continuous, watertight barrier wall.

Since the pre-fabricated panels of the present invention include rubber as a material of construction, they do not crack or buckle under stress from earth fill settlement, earthquake, explosion, or hydrostatic pressure, such as concrete, wooden, or metal members are prone to do. The panels of the present invention also prevent earthen containment failure caused by rodents and other earth-boring animals. The top of the assembled panels is fitted with an erosion shield to divert earthen containment overflow away from the earthen containment and thus prevent undermining and erosion.

The system of the present invention provides a simple and cost effective solution to the failure of earthen containments due to erosion from floodwaters. Hence, an object of the present invention is to provide an earthen containment reinforcement system that is effective and that employs recyclable materials, and is thus economical to fabricate and maintain.

Yet another object of the present invention is to provide an earthen containment reinforcement system that is not only waterproof, but that has the requisite structural integrity to resist shock arising from movement of the surrounding soil as a result of earthquakes or explosions.

Furthermore, since the disposal of used tires poses an environmental challenge, another object of the present invention is to provide a useful application for recycled used vehicle tires.

Yet another object of this invention to be specifically enumerated herein is to provide an earthen containment reinforcement system in accordance with the preceding objects which will conform to conventional forms of manufacture, be of simple and inexpensive construction and easy to use so as to provide a structure that will be economically feasible, long lasting, durable in service, relatively maintenance-free in use, and a general improvement in the art.

These together with other objects and advantages which will become subsequently apparent reside in the details of construction and operation as more fully hereinafter described and claimed, reference being had to the accompanying drawings forming a part hereof, wherein like reference numbers refer to like parts throughout. The accompanying drawings are intended to illustrate the invention, but are not necessarily to scale.

DETAILED DESCRIPTION OF THE PREFERRED EMBODIMENTS

Figure 1:
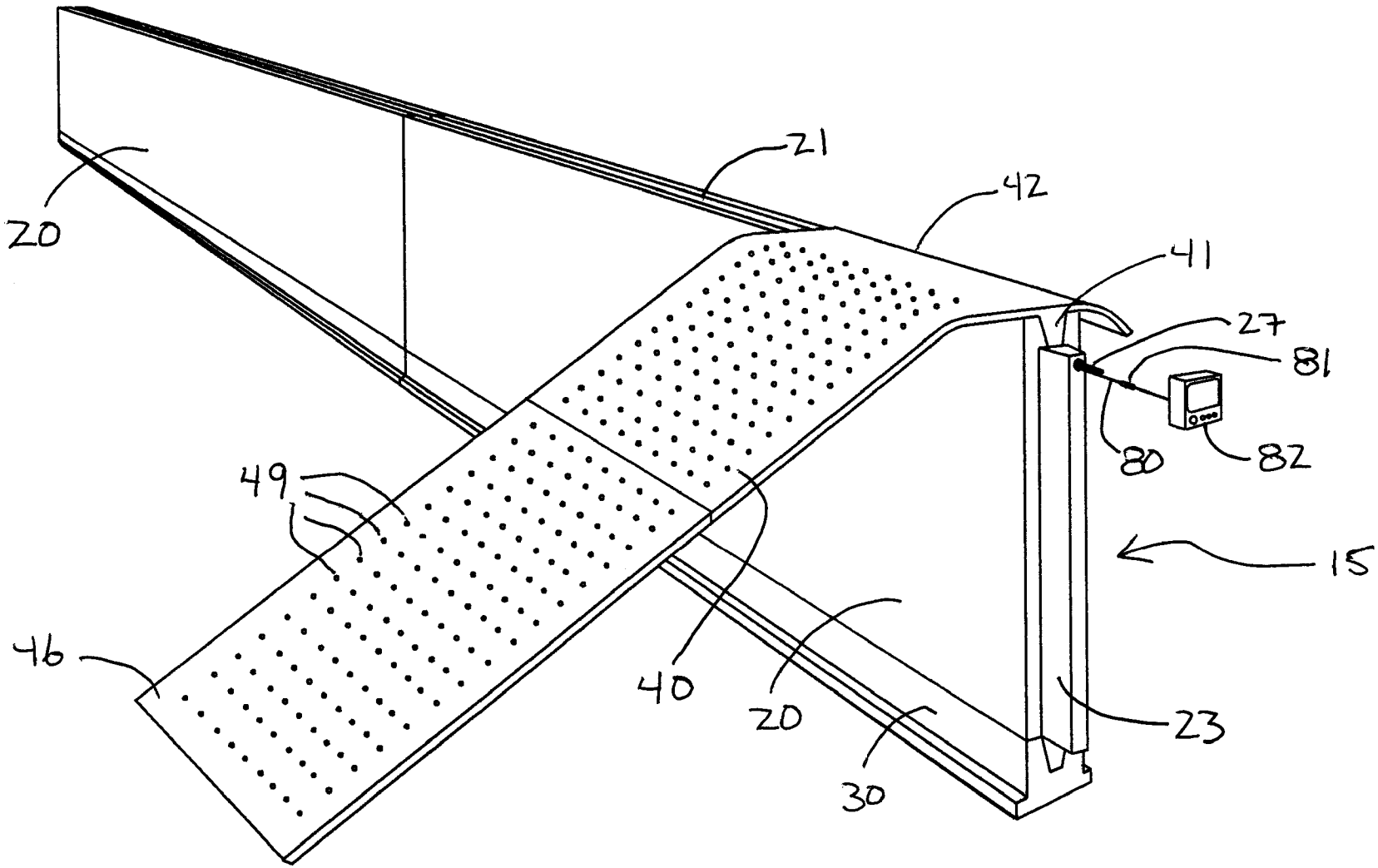
FIG. 1 is a perspective view of a series of interconnected pre-fabricated panels with an assembled erosion shield for an earthen containment reinforcement system according to a first embodiment of the present invention.

Although only preferred embodiments of the invention are explained in detail, it is to be understood that the invention is not limited in its scope to the details of construction and arrangement of components set forth in the following description or illustrated in the drawings. The invention is capable of other embodiments and of being practiced or carried out in various ways.

Also, in describing the preferred embodiments, terminology will be resorted to for the sake of clarity. It is intended that each term contemplates its broadest meaning as understood by those skilled in the art, and includes all technical equivalents which operate in a similar manner to accomplish a similar purpose.

Figure 2:
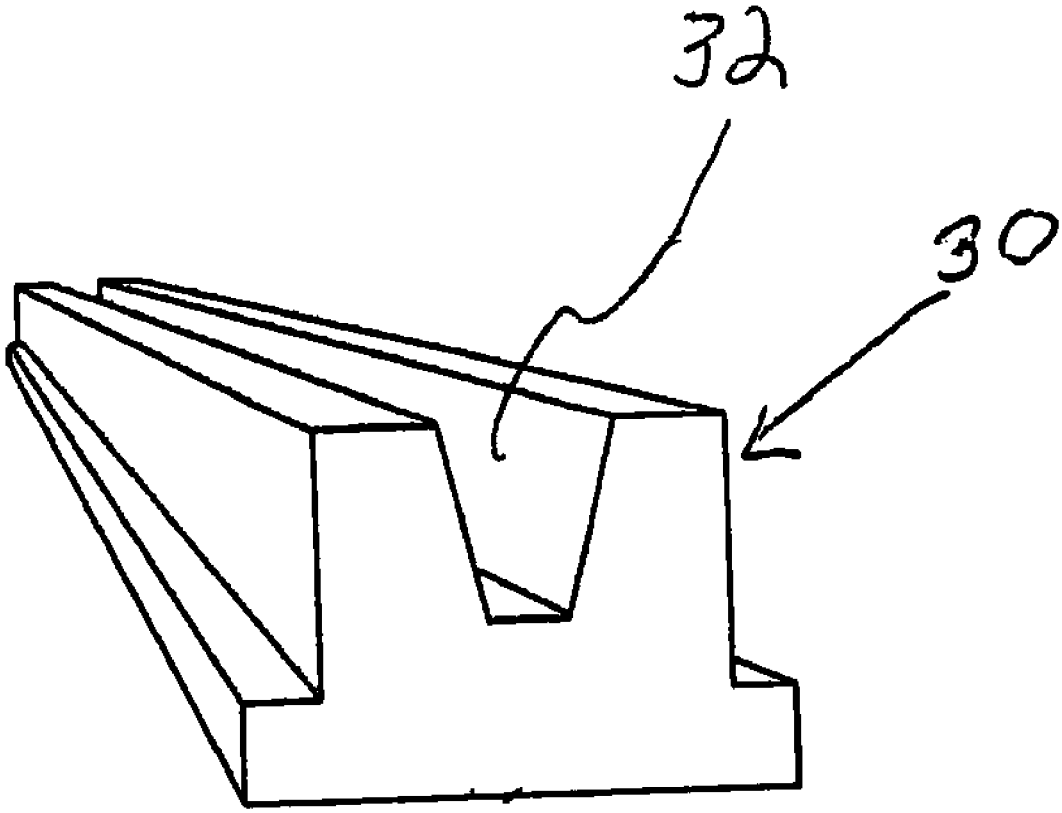
FIG. 2 is a perspective view of a base for the assembly illustrated in FIG. 1.
Figure 3:
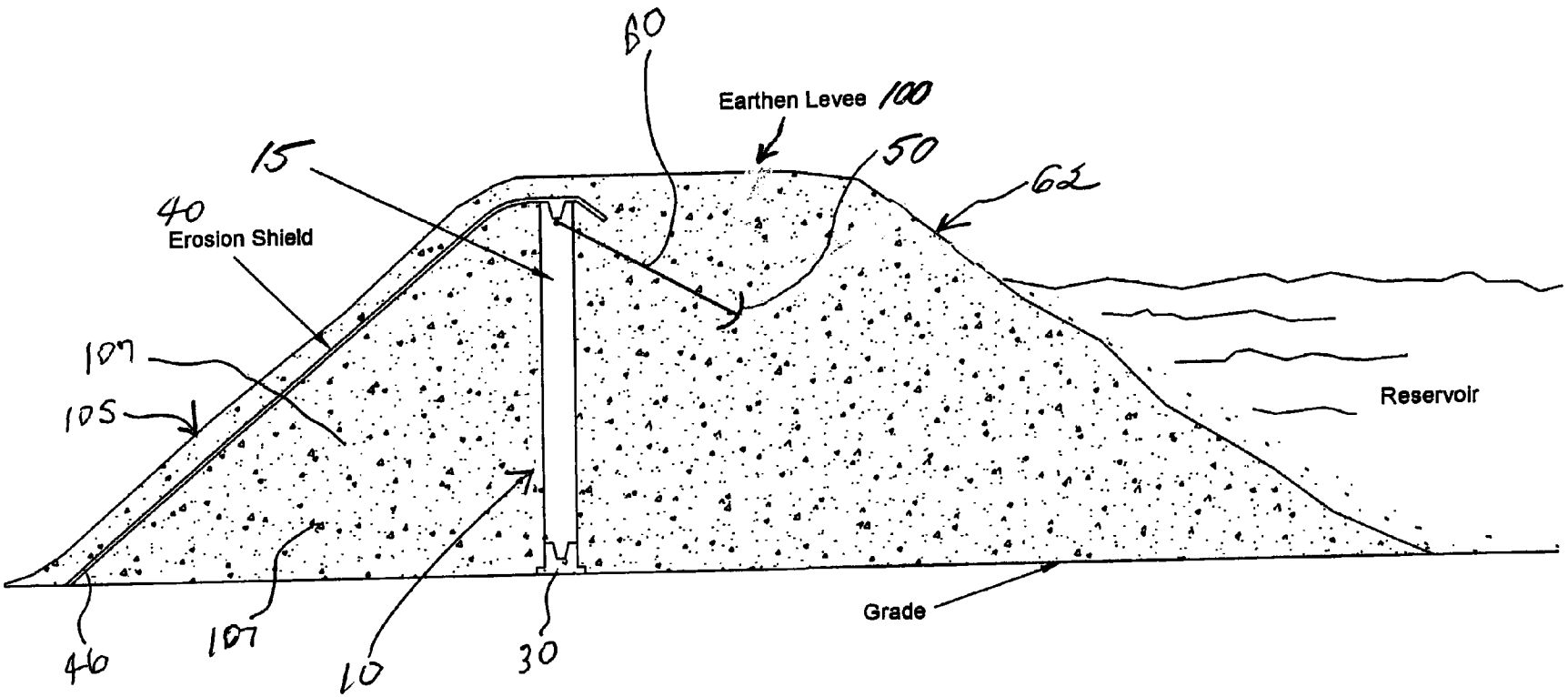
FIG. 3 is a cross-sectional view of the earthen containment reinforcement system according to the first embodiment of the present invention.

Referring to the drawings, FIGS. 1-3 illustrate an earthen containment reinforcement system 10 according to a first embodiment of the present invention. The system 10 includes a retaining or barrier wall, generally designated by reference numeral 15, located inside an earthen containment 100 (see FIG. 3). The wall 15 is made up of a series of vertically-oriented, interconnected wall panels 20. As shown in FIG. 1, the wall panels 20 are connected end-to-end so as to extend along the length of the earthen containment 100. The bottom of each panel 20 connects to and is supported on a base 30 which is sized to be longer than the length of panel 20. The top of each panel 20 connects to an erosion shield 40 located on the land side 105 of the earthen containment 100.

For purposes of illustration, FIG. 3 shows a single panel 20 supported on the base 30 and connected to the erosion shield 40. Depending upon the height of the earthen containment, however, a plurality of the panels 20 can be stacked vertically as described below.

FIG. 3 is a sectional view of the earthen containment reinforcement system 10 as it would appear once in place within the earthen containment 100. Once installed, the entire reinforcement system 10 is covered with soil 107. Each panel 20 rests on a base 30, which is preferably flat on the bottom to aid in stability. In the preferred embodiment, the base 30 has a length of about 35 feet, and has a top groove 32 to receive the tongue 22 from the bottom of each panel 20. The panels 20 are thus received into pre-fabricated crumb rubber bases to distribute the load of the reinforcement system and to deter settling.

Base 30 can be molded from either recycled tire "crumb" rubber or from recycled waste plastic. Crumb rubber is commercially available from secondary rubber recyclers/processors. The crumb rubber is available in various grades, or particle size, typically referred to as "mesh." According to a preferred embodiment of the invention, the crumb rubber that is used is 10-20 mesh.

The retaining wall 15 is preferably secured by a plurality of anchors 50 strategically spaced along the length of the wall 15. In the preferred embodiment, the anchor 50 is located below grade in the retained-water side 62 of the earthen containment 100 and has a partial spherical shape with a concave portion facing the reinforcing cable. A metal anchor having this partial spherical shape with the concave portion is known as a "spoon anchor." Once surrounded by soil 107, the anchor 50 is resistant to movement by virtue of its concave partial spherical shape.

A tether or anchor cable 60 extends from each anchor 50 and connects to a cable extending through the top of the panels 20, as described below. The tether cable extends diagonally downward through the earthen containment 100 from the reinforcing cable to the anchor 50. Should the earthen containment erode from the wave action on the reservoir side 62, the anchors 50 and panels 20 will remain in place to secure the earthen containment on the land side 105 of the wall 15. Should the earthen containment overflow, the erosion shield 40 will deter undercutting of the earthen containment as water is directed away from the soil on land side 105 of the wall 15.

According to another embodiment of the invention, the retaining wall 15 is anchored by a plurality of reinforced concrete piers or pilings strategically spaced along the length of the wall 15. For example, the vertical piers can be positioned approximately 4 ft from the wall and at 150 ft intervals along the entire length of the wall. The piers can be formed in 12-inch diameter holes bored through the earthen containment starting from the top and extending 15 ft below grade. Four strands of rebar are set in the holes, which are then filled with concrete to form the pilings. Alternatively, the reinforced pilings can be precast at an offsite location and be in stock when constructing the reinforcement system 10. In the pier embodiment of the anchor, the tether or anchor cable 60 extends from near the top each pier and connects to the cable extending through the top of the panels 20.

Figure 4:
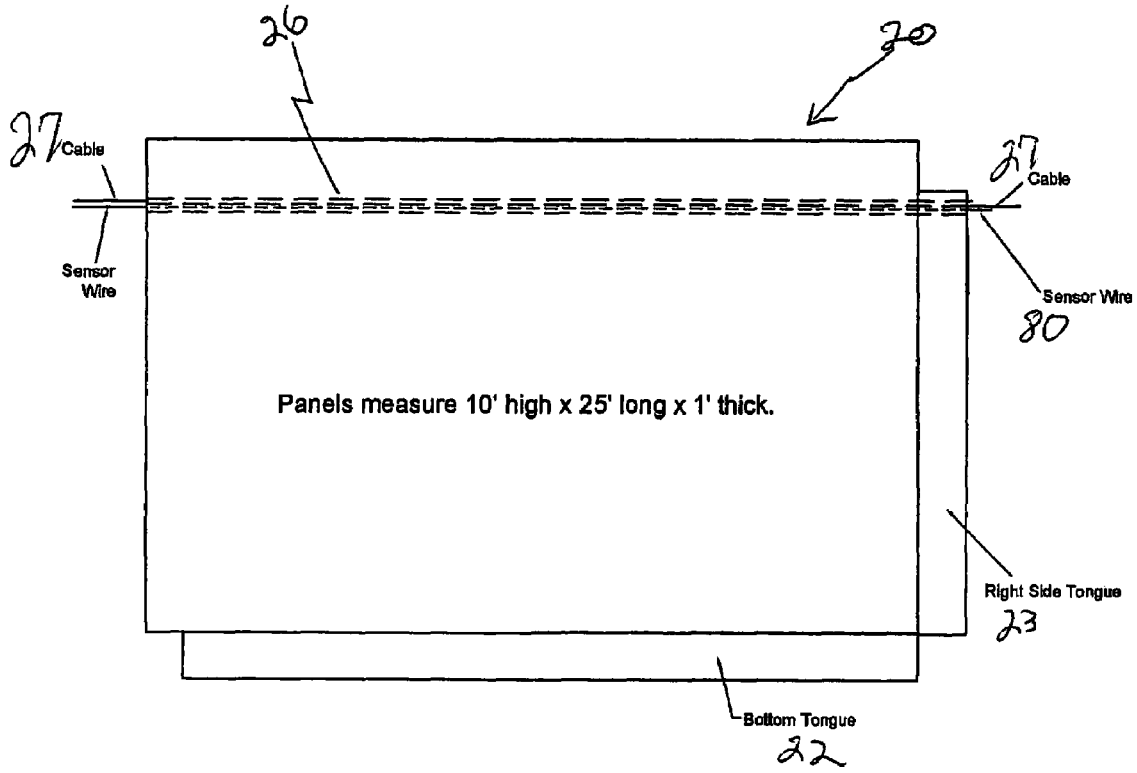
FIG. 4 is a front elevation view of one of the pre-fabricated panels illustrated in FIG. 1.

FIG. 4 is a front elevation view of a preferred panel 20. In this preferred embodiment, the panel 20 has a height of about 10 feet, a length of between about 20 feet and about 60 feet, more preferably about 25 feet, and a thickness up to 3 feet, more preferably about 1 foot. A side connecting tongue 23 extends from one side of each panel and a corresponding groove 24 is provided in the opposite side (see FIG. 5) to mate the ends of the panels to each other.

An adhesive, preferably a polyurethane-based glue, is applied to the side and top/bottom joints of the panels 20 prior to fitting adjacent panels together. Such polyurethane-based glue is available in various brand names from existing manufacturers, such as, for example, Calhoun Plastics & Chemical, Calhoun, Ga., and POLYMERight, Inc., Fremont, Calif. These adhesives, or binders, are commonly used in the binding of crumb rubber to make secondary rubber products.

Embedded longitudinally in the core of each panel 20 is a conduit, preferably PVC pipe 26, that extends horizontally along the length of the panel 20. The pipe 26 is preferably near the top of each panel and the conduits are all aligned longitudinally when the panels 20 are assembled. The conduit 26 houses a panel wire cable 27 to further tie the panels together and to the anchors. More specifically, the tether or anchor cable 60 attached to each anchor 50 is connected to the panel wire cable 27 through a hole 28 in the panel wall and pipe 26. This connection anchors the panels 20 to the anchors 50. The conduit 26 can also house a sensor wire 80 for an electrical sensory system, described hereinafter.

Figure 8:
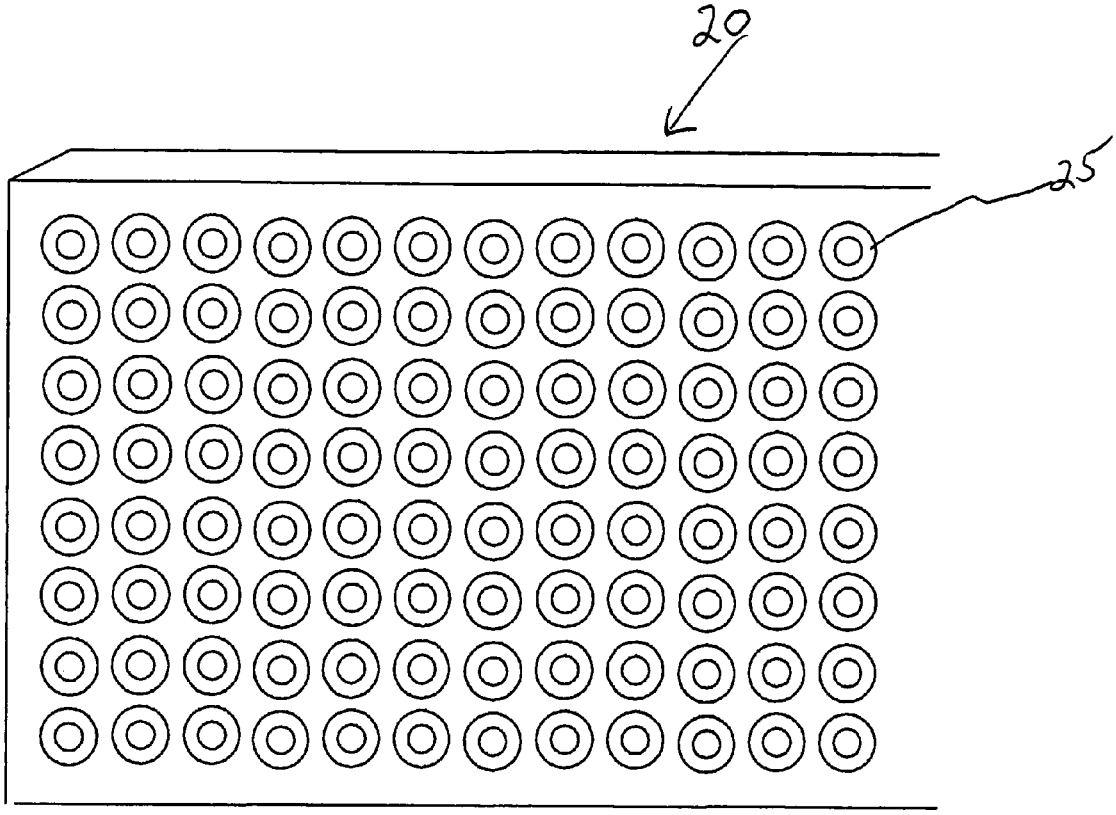
FIG. 8 is a detailed perspective view of the pre-fabricated panel of the present invention, showing a plurality of adhesion pockets for the exterior front and rear surfaces of the panel.

As shown in FIG. 8, the front exterior surface of the panel 20 includes a plurality of spaced recesses or adhesion pockets 25. Though not illustrated, the rear exterior surface of the panel 20 also includes similar spaced recesses 25. The recesses 25 are configured to promote adhesion of the panel 20 to the soil 107 of the earthen containment. That is, the recesses 25 fill with soil and thereby enhance adhesion of the layer of soil to the panel 20. This feature also enhances the structural integrity of the earthen containment reinforcement system 10. According to a preferred embodiment, each recess 25 has a surface diameter of about 12", a bottom diameter of about 7", and a depth of about 4". The recesses 25 are configured to align with the opening of each corresponding tire bead that is embedded in the panel 20.

Figure 5:
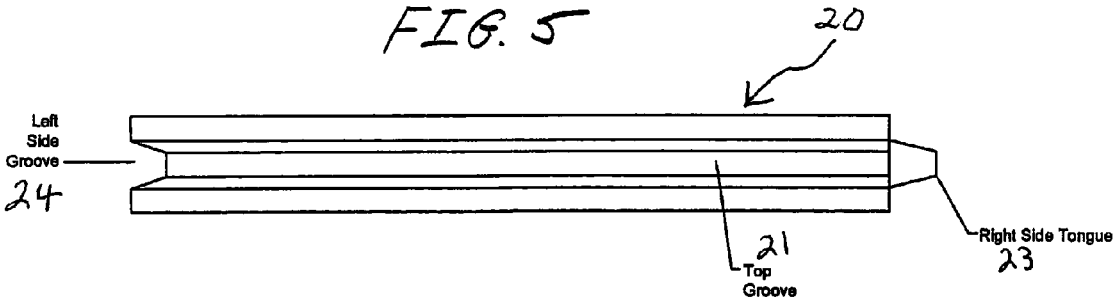
FIG. 5 is a top plan view of the panel illustrated in FIG. 4.
Figure 7:
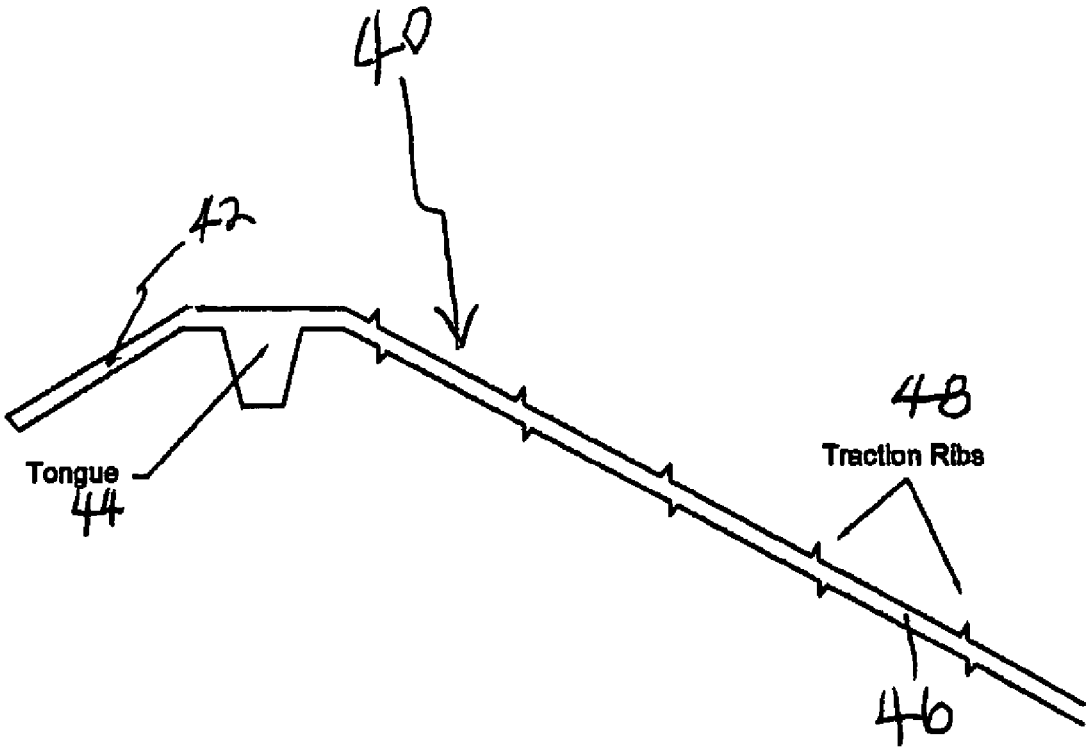
FIG. 7 is a side view of the erosion shield illustrated in FIG. 3.

As shown in FIG. 5, in one embodiment of the connecting joint, a tongue and groove configuration is used to ensure alignment and to provide a watertight seal when the panels are connected vertically and laterally to form the wall 15. The top of each panel has a tapered groove 21 running laterally. The bottom of each panel above has a matching tongue 22 that fits into the groove 21 of a lower panel to complete the joint. This same groove 21 in the topmost panel is used to receive the tongue 44 of the erosion shield 40 when it is fitted to the top panel.

Figure 6:
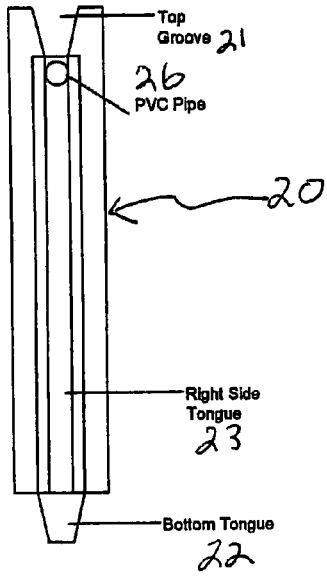
FIG. 6 is a side elevation view of the panel illustrated in FIG. 3.

FIG. 6 is a right side view of the panel 20 showing the tongue and groove joint, the groove 21 of the panel top and the tongue 22 of the panel bottom. The left side of the panel carries the matching tongue and groove joint.

As shown in FIGS. 1 and 3, an erosion shield 40 connects to the top of each topmost panel and extends the length of each panel. The erosion shield 40 is fitted into the top of the each panel on the land side 105 of the earthen containment and runs the entire length of the wall 15. The erosion shield 40 is a relatively thin structure configured to divert reservoir overflow away from the earthen containment to prevent scouring and soil erosion. In a preferred embodiment, the erosion shield 40 is a 1-inch-thick "mat" of compressed tire crumb that extends just under the surface of the earthen containment from the top of the wall 15 down to grade. The erosion shield 40 is made of 10-20 mesh crumb rubber as described above for base 30. The 10-20 mesh crumb is compressed in a mold with a polyurethane binder. The head 42 of the erosion shield has a tongue 44 that fits into the groove 21 at the top of any of the panels 20. The tail 46 of the shield angles downwardly to follow the slope of the earthen containment.

The erosion shield is made in sections from head 42 to tail 46. The preferred transverse width along head 42 is 10 feet. The preferred length from head 42 to tail 46 is 20 feet. This top section incorporates the tongue 41 for attachment to the panel 20. A second section without the tongue is added to tail 40 of the top section when additional length is required. Adjacent sections are connected to one another using a suitable fastener, such as stainless steel bands.

Figure 19:
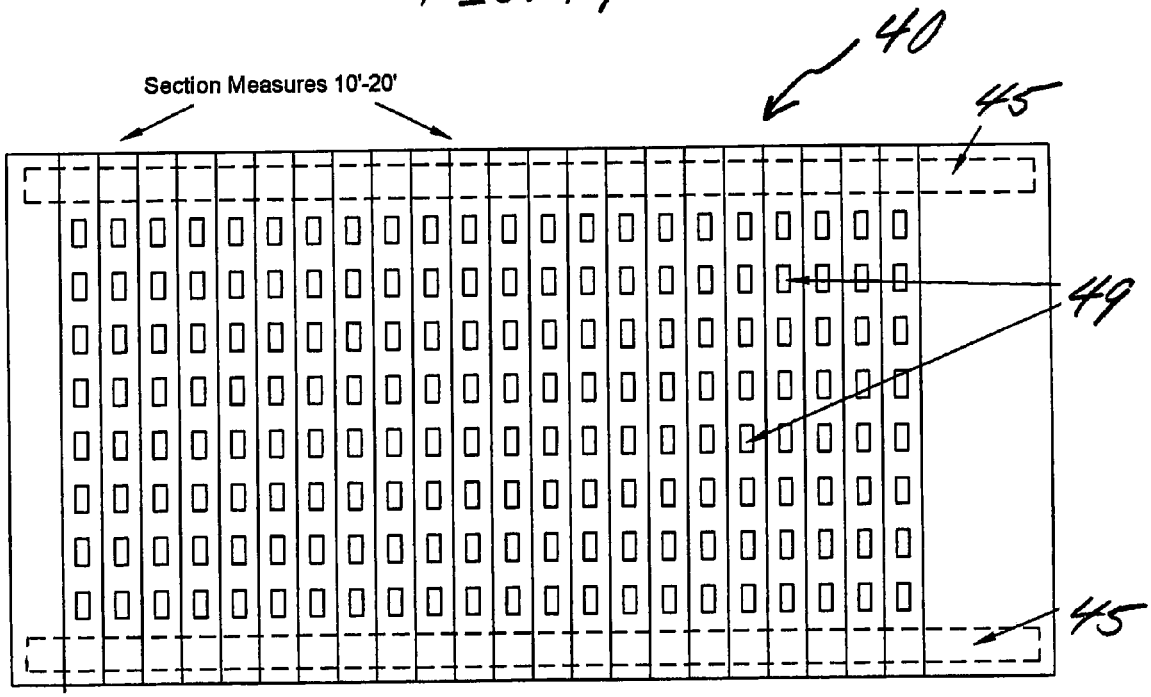
FIG. 19 is a top plan view of an erosion shield according to another embodiment of the invention.
Figure 20:
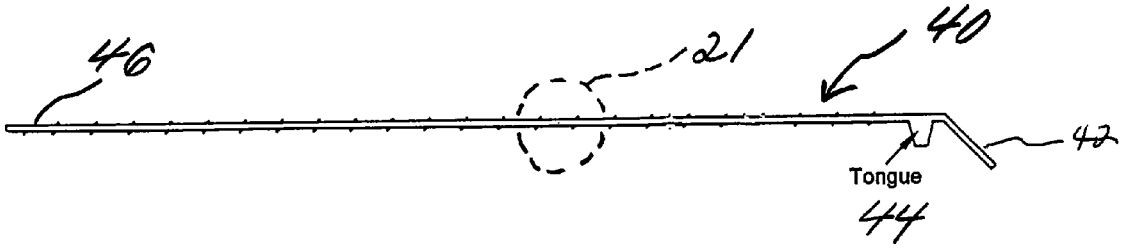
FIG. 20 is a side view of the erosion shield illustrated in FIG. 19.
Figure 21:
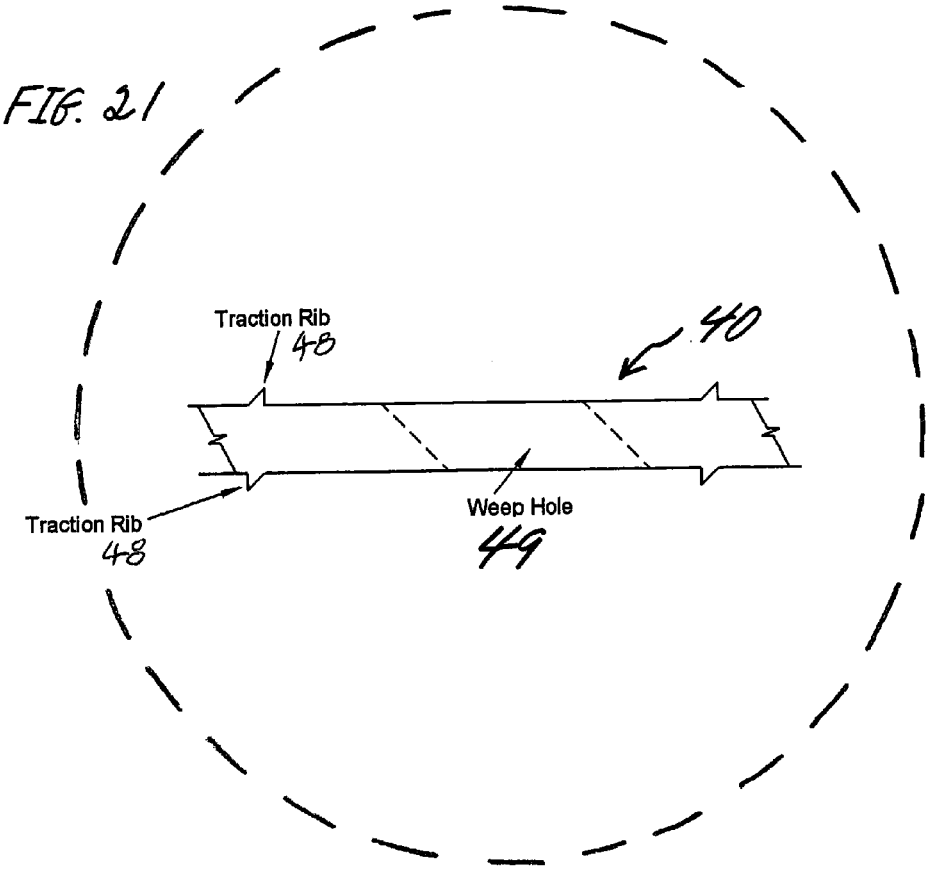
FIG. 21 is an enlarged partial view of the erosion shield illustrated in FIG. 20.

In accordance with one embodiment of the invention illustrated in FIGS. 19-21, the erosion shield has weep holes 49 that allow water to percolate through to the soil 107, and has traction ribs along its upper and lower surface as at 48 to keep the soil 107 that is piled on top of it from eroding away. As soil settles into the weep holes 49 it aids in adhering the mat to the earthen containment. The traction ribs 48 are made as an integral part of the molding process.

Figure 22:
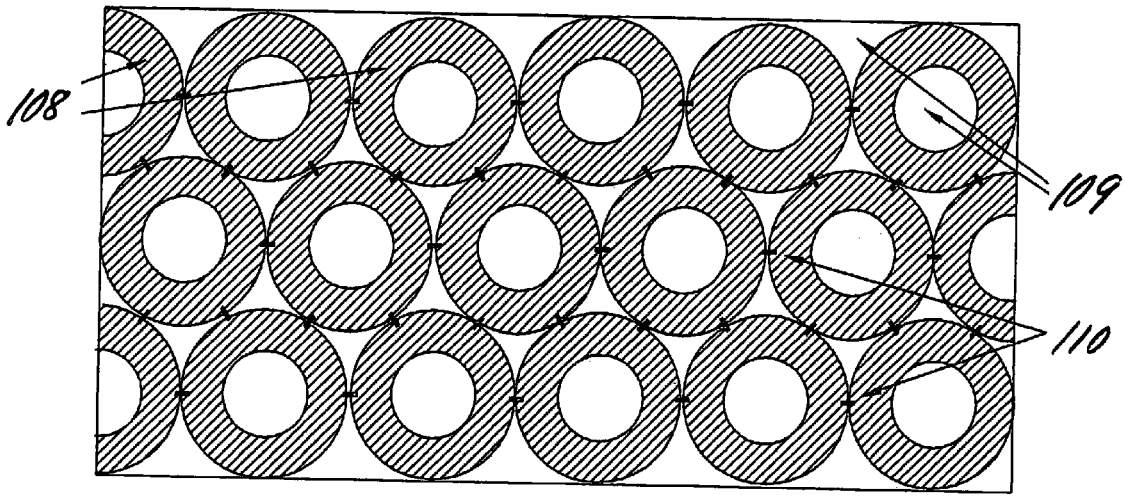
FIG. 22 is a top plan view of an erosion shield according to still another embodiment of the invention.
Figure 23:
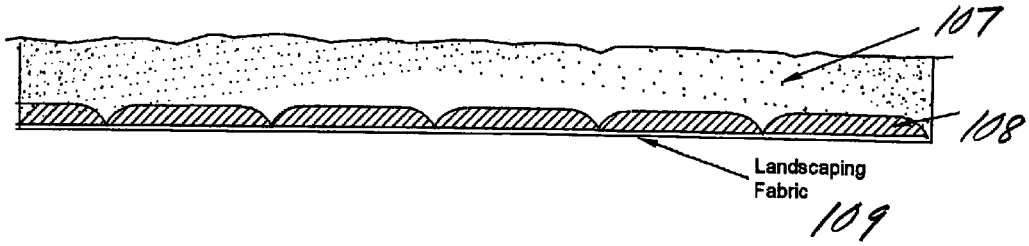
FIG. 23 is a cross-sectional view of the erosion shield illustrated in FIG. 22.

In an optional embodiment illustrated in FIGS. 22 and 23, the erosion shield 40 is a layer of connected half truck tires 108 placed on a sheet of landscaping fabric 109. The landscaping fabric 109 enables any water that is present to percolate into the soil 107. Each half truck tire 108 is the sidewall portion of the tire, and the sidewalls are connected together at their intersections by a clamp 110 to form a grid. The layer of half truck tires 108 is covered by a layer of soil 107. Use of the large truck tires for this embodiment of erosion shield 40 is advantageous because disposal of such tires is problematic.

Figure 9:
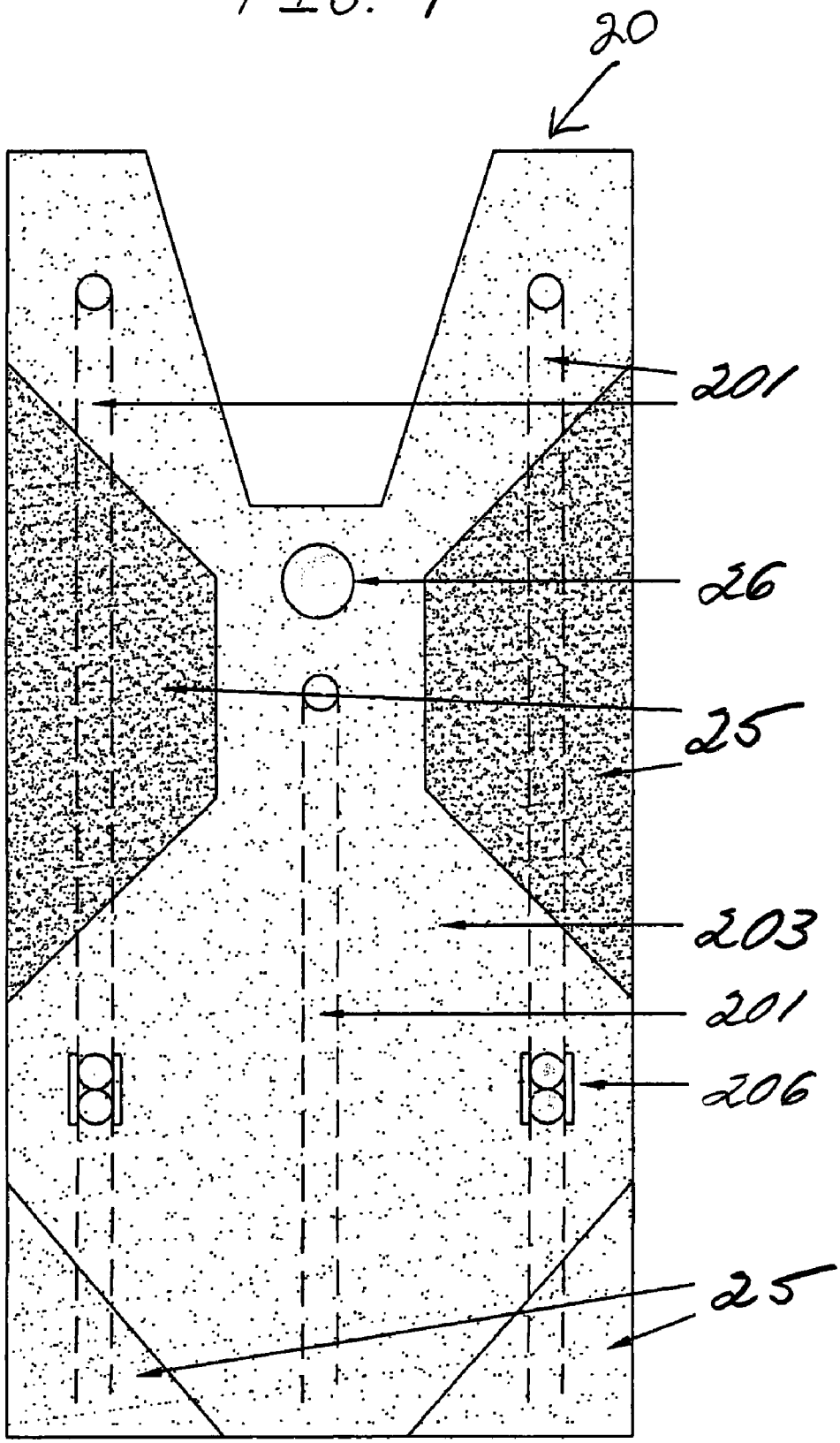
FIG. 9 is a side cross-sectional view of the panel illustrated in FIG. 8, showing a fill component and a reinforcing grid.
Figure 10:
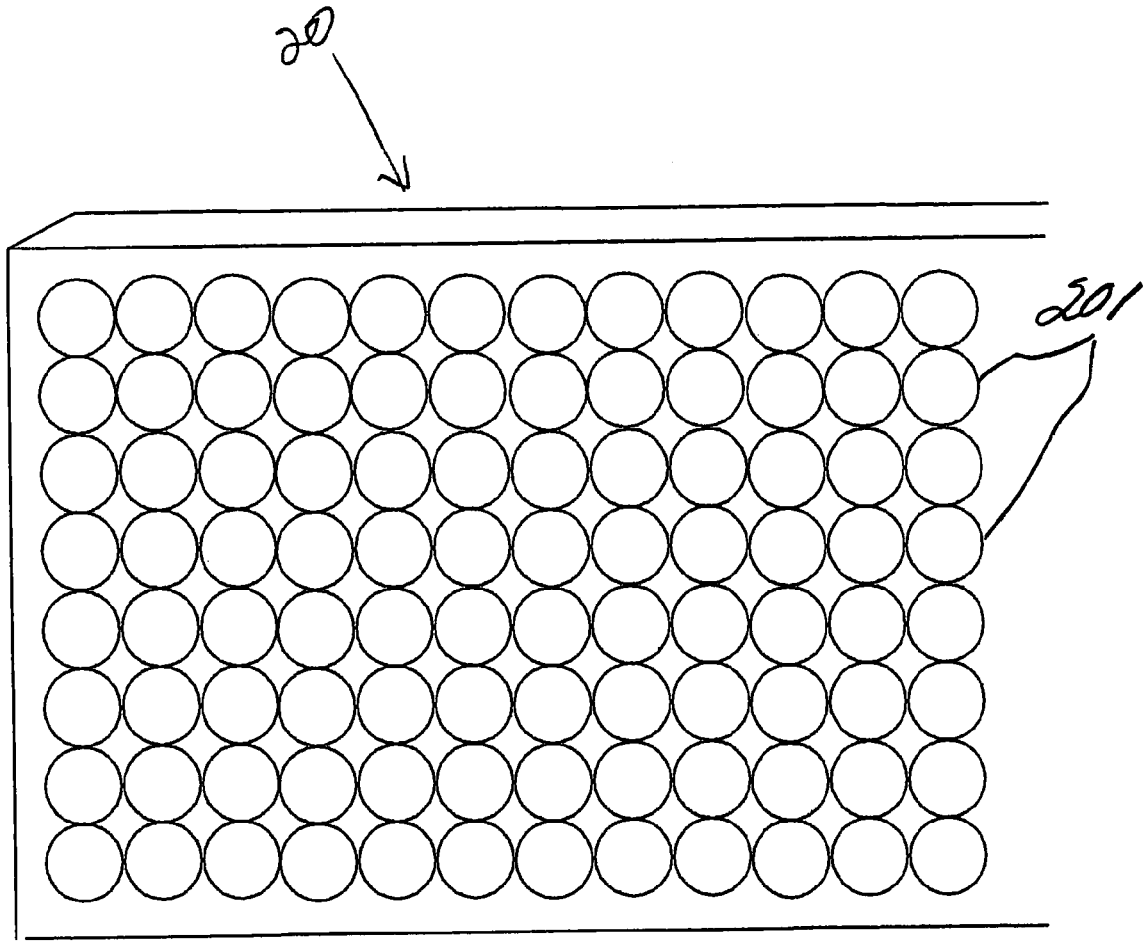
FIG. 10 is a partial cross-sectional perspective view of the panel illustrated in FIG. 8, showing the reinforcing grid.

FIG. 9 is a cross-sectional view of a preferred panel 20 for the earthen containment reinforcement system of the present invention. These panels 20 are constructed of used car and truck tires. The core of the panels includes a series of reinforcing grids constructed of tire beads 201 (i.e., the tire bead is that portion of each side of a tire casing where the tire mounts to the vehicle wheel). The tire bead 201 provides structural strength and rigidity to the panel. As shown in FIG. 10, the reinforcing grid is constructed of a plurality of the steel beads 201. The beads 201 are cut from the tires and are connected to one another at their intersections by a bead clamp 206. To provide a watertight barrier, 10-20 mesh-sized tire crumb 203 is laid around the grids to form the panel 20. These materials are mixed with polyurethane binders, poured into molds, and then compressed under hydraulic pressure and heat to form the finished panel 20.

More specifically, the reinforcing grids are made by clamping tire beads 201 together at their intersections using steel compression clamps 206. A mixture of 10-20 mesh crumb rubber 203 and polyurethane adhesive is poured into the panel mold. The mold, typically metal, is of a construction that is compatible with the temperatures and pressures experienced in the molding process. A first reinforcing grid of tire bead 201 is placed in the mold, and a mixture of crumb 203 and polyurethane adhesive is poured on top of the grid. Additional grids of tire bead 201 and rubber particles 203 are laid on top of each other as required to achieve the desired rigidity and strength. FIG. 9 is a sectional view showing three reinforcing grids in place. FIG. 9 also illustrates that the adhesion pockets 25 are positioned to fit into the center of each tire bead 201 of the grid. The number of the above-described layers that is required is determined by the rigidity and strength requirements of a particular containment service. A final fabrication step includes adding another layer of 10-20 mesh crumb rubber 203. The layered mold is then compressed hydraulically and heated to form the finished, watertight panel 20.

Figure 11:
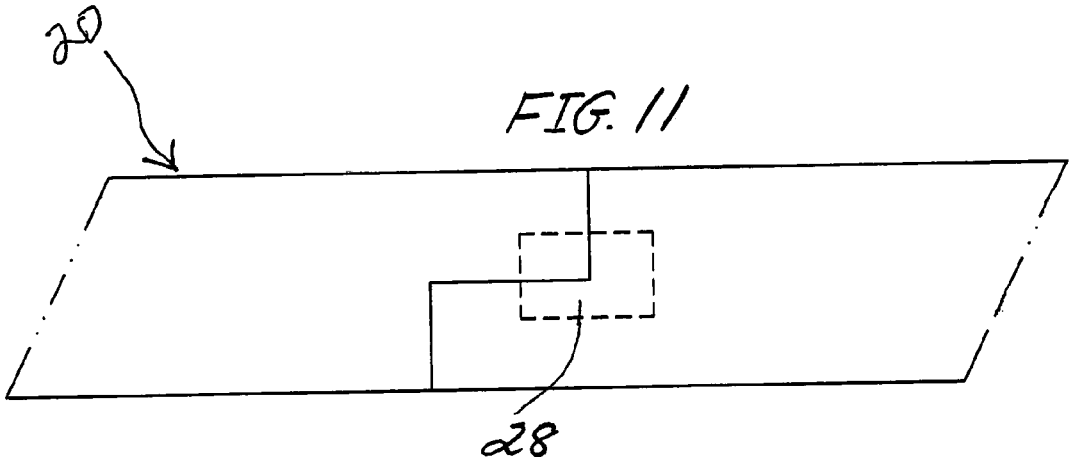
FIG. 11 is a schematic top view of adjacent panels as shown in FIG. 1, joined by a rabbet joint embodiment of the panel connecting joint.
Figure 12:
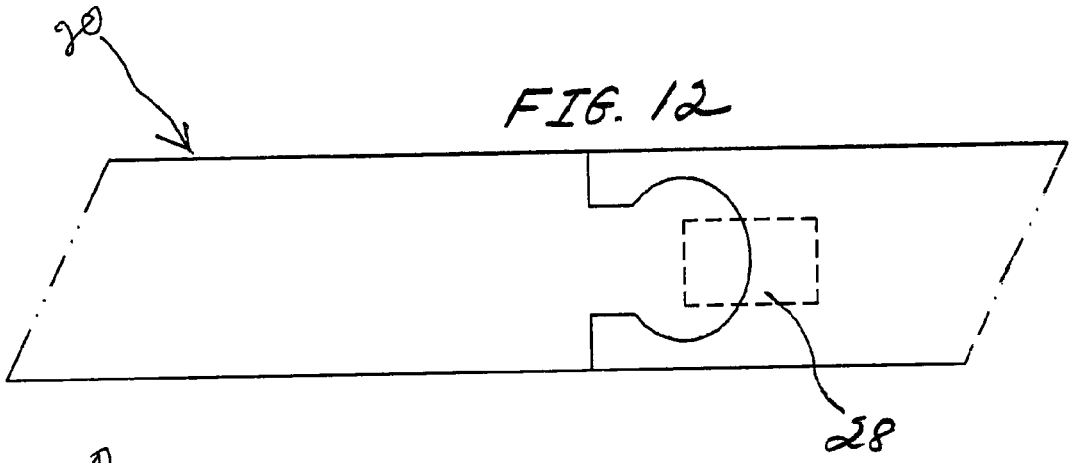
FIG. 12 is a schematic top view of adjacent panels as shown in FIG. 1, joined by a ball joint embodiment of the panel connecting joint.
Figure 13:
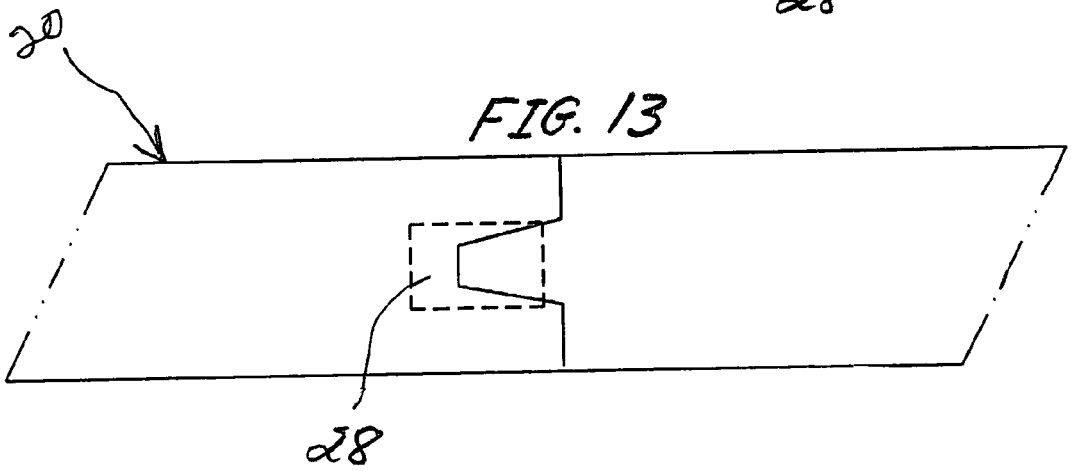
FIG. 13 is a schematic top view of adjacent panels as shown in FIG. 1, joined by a tongue and groove embodiment of a panel connecting joint.

As shown in FIGS. 11-13, various types of connecting joints can be employed for connecting the panels 20 end-to-end and top-to-bottom. The joint may be a rabbet configuration (FIG. 11), a ball and joint configuration (FIG. 12), or a tongue and groove configuration (FIGS. 4-7 and 13). For each end of panel 20, a preferred joint configuration is the rabbet configuration (FIG. 11). The rabbet configuration is preferred at the panel end location because on uneven terrain, there may be some amount of lateral separation between the ends of adjacent panels. For example, at the bottom of adjacent panels the end edges may be in contact, but at the top of the adjacent panels the end edges may be slightly separated. The rabbet joint, by virtue of its configuration, ensures that in this situation the facing edges of the opposed joints remain in contact with one another, thereby maintaining the watertight seal. For the top and bottom of each panel 20, a preferred joint configuration is the tongue and groove configuration (FIG. 13). Regardless of which joint is employed, the panels are further secured to one another as described above by applying adhesive to each joint to provide enhanced joint integrity.

Figure 14:
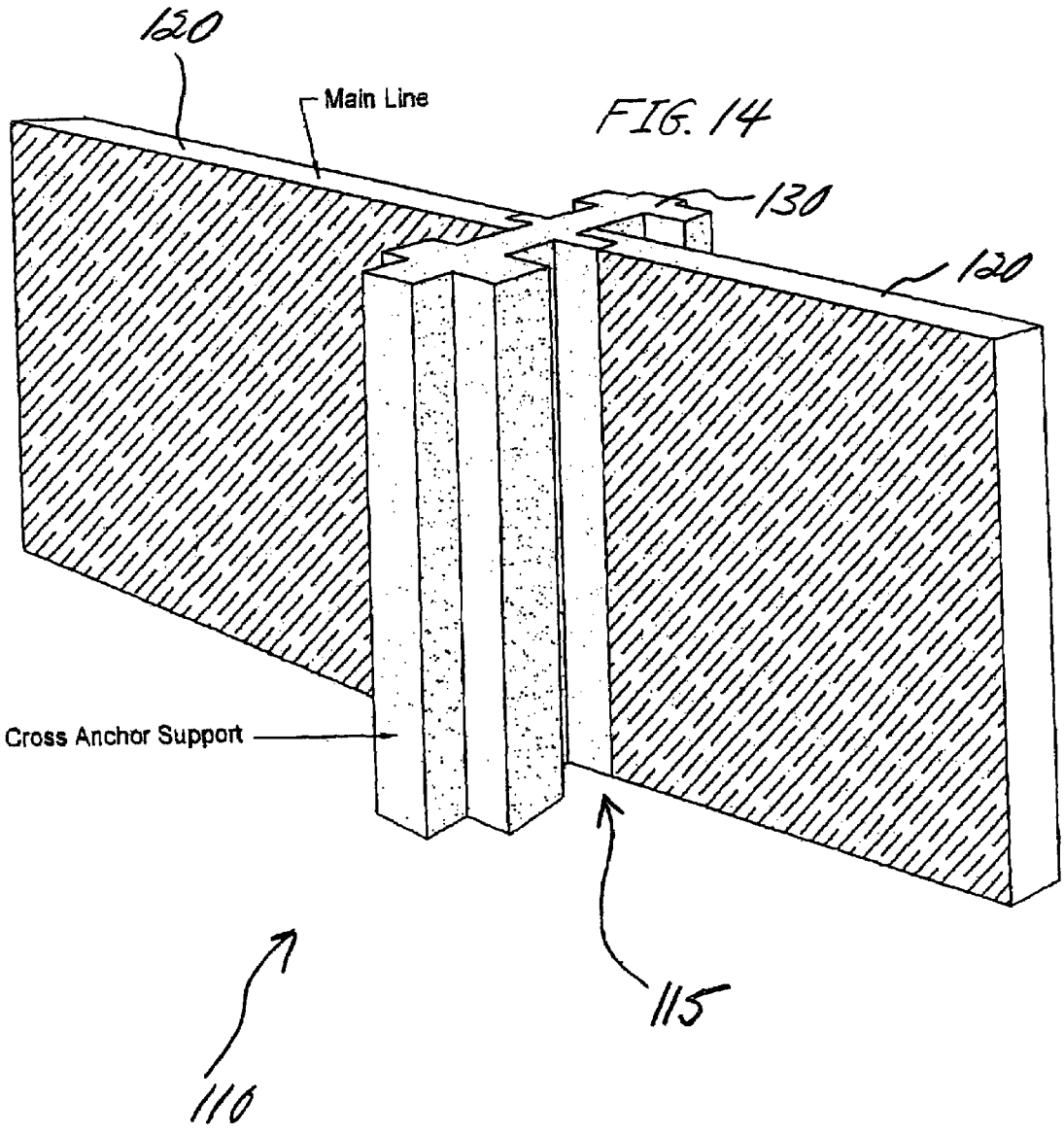
FIG. 14 is a perspective view of a retaining or barrier wall for an earthen containment reinforcement system according to a second embodiment of the present invention utilizing a cross anchor support structure.
Figure 15:
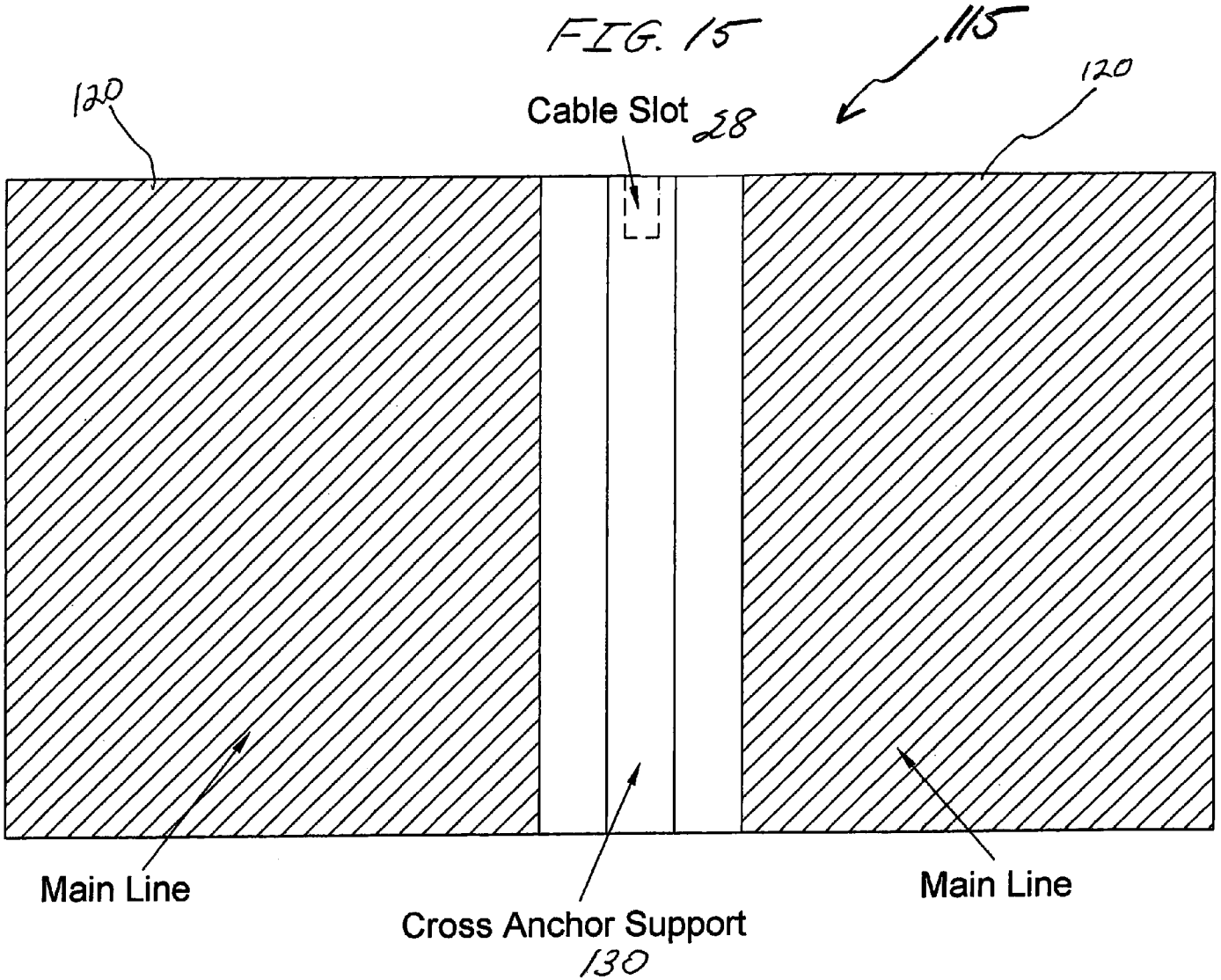
FIG. 15 is a front elevation view of the barrier wall illustrated in FIG. 14.
Figure 16:
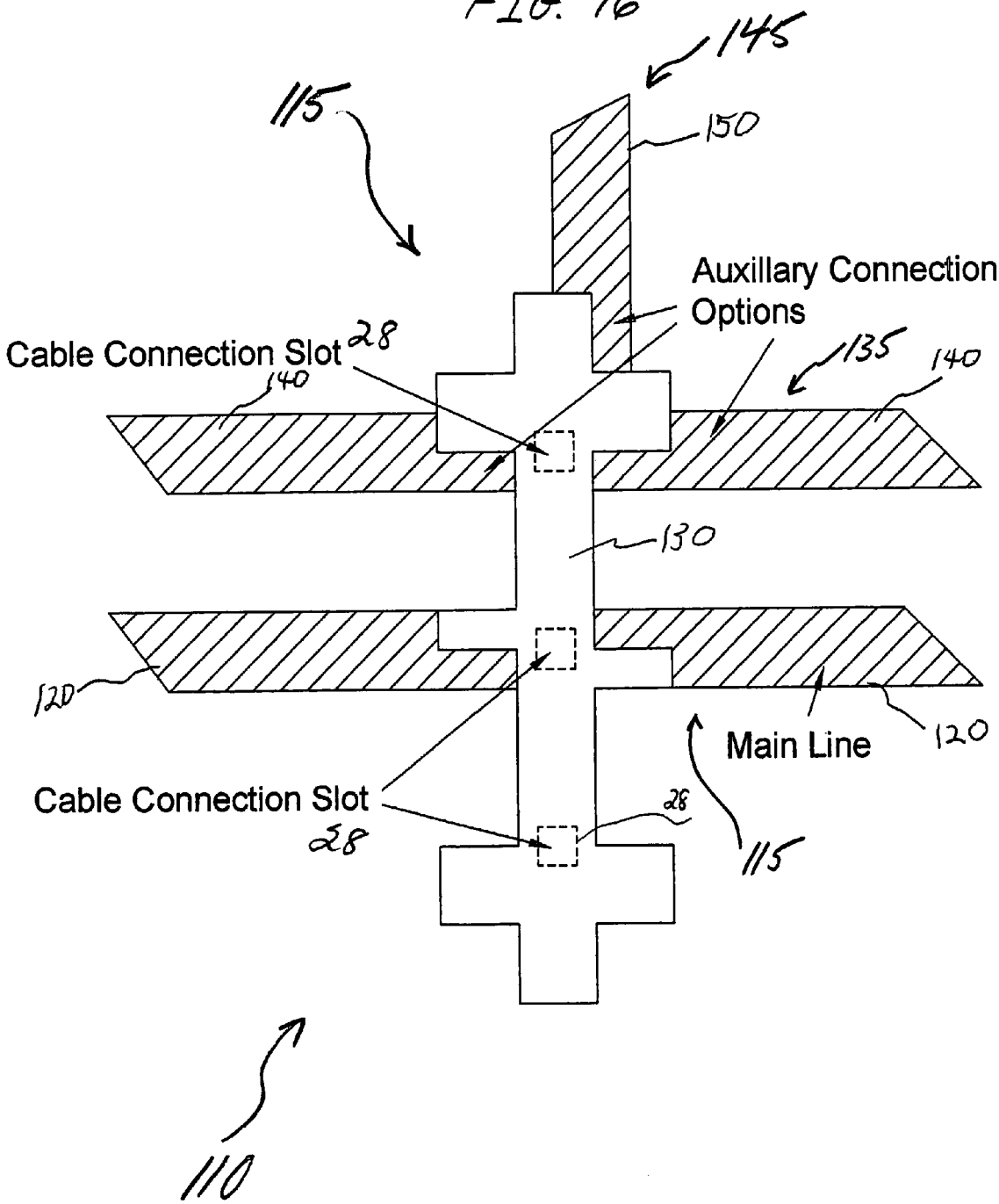
FIG. 16 is a top plan view of interconnected barrier walls using the cross anchor support structure of the present invention.

FIGS. 14-16 illustrate a cross anchor earthen containment reinforcement system, generally designated by reference number 110, according to a second embodiment of the present invention. According to this embodiment, a cross anchor support 130 connects and supports adjacent panels 120. The supports 130 that connect to adjacent panels 120 form a reinforcement wall 115 that provides for right angle corners and lateral (side-to-side) support for the system 100. The cross anchor supports 130 are also molded from recycled tire crumb 203 and reinforcing grids of tire bead 201. The cross anchor support embodiment of the invention facilitates forming right-angle corners and multiple walls.

As shown in FIG. 16 the cross anchor embodiment of the present invention provides for the assembly of an auxiliary reinforcing wall, generally designated by reference numeral 135, employing panels 140, which runs parallel to the main reinforcing wall 115, and/or an auxiliary reinforcing wall, generally designated by reference numeral 145, made up of panels 150, which is assembled perpendicularly to the main wall 115. This assembly may provide greater flexibility in designing the reinforcement wall structure.

Figure 17:
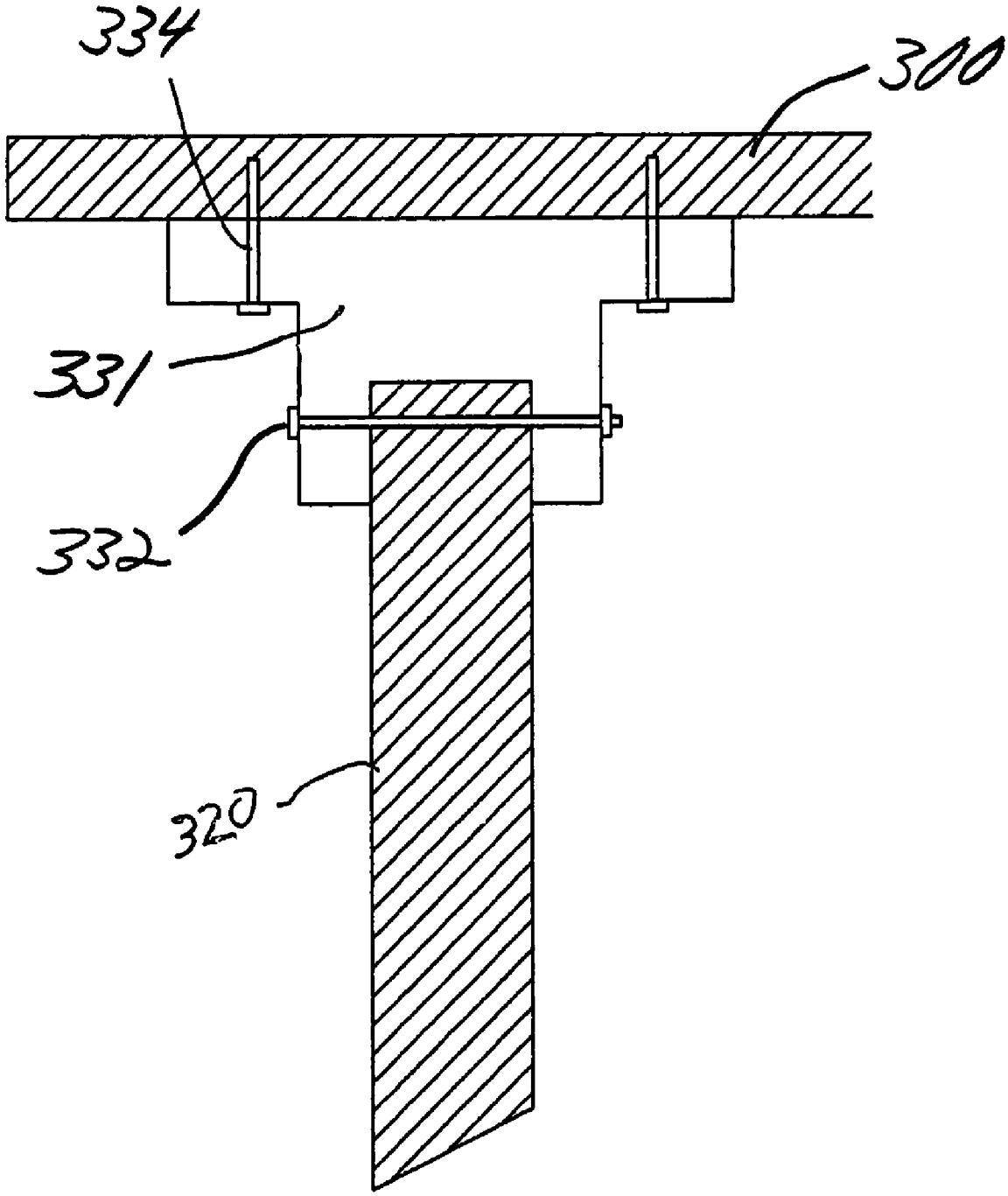
FIG. 17 is a top plan view of a bulkhead fastener with a modified tongue and groove connecting joint for a barrier wall according to the present invention.
Figure 18:
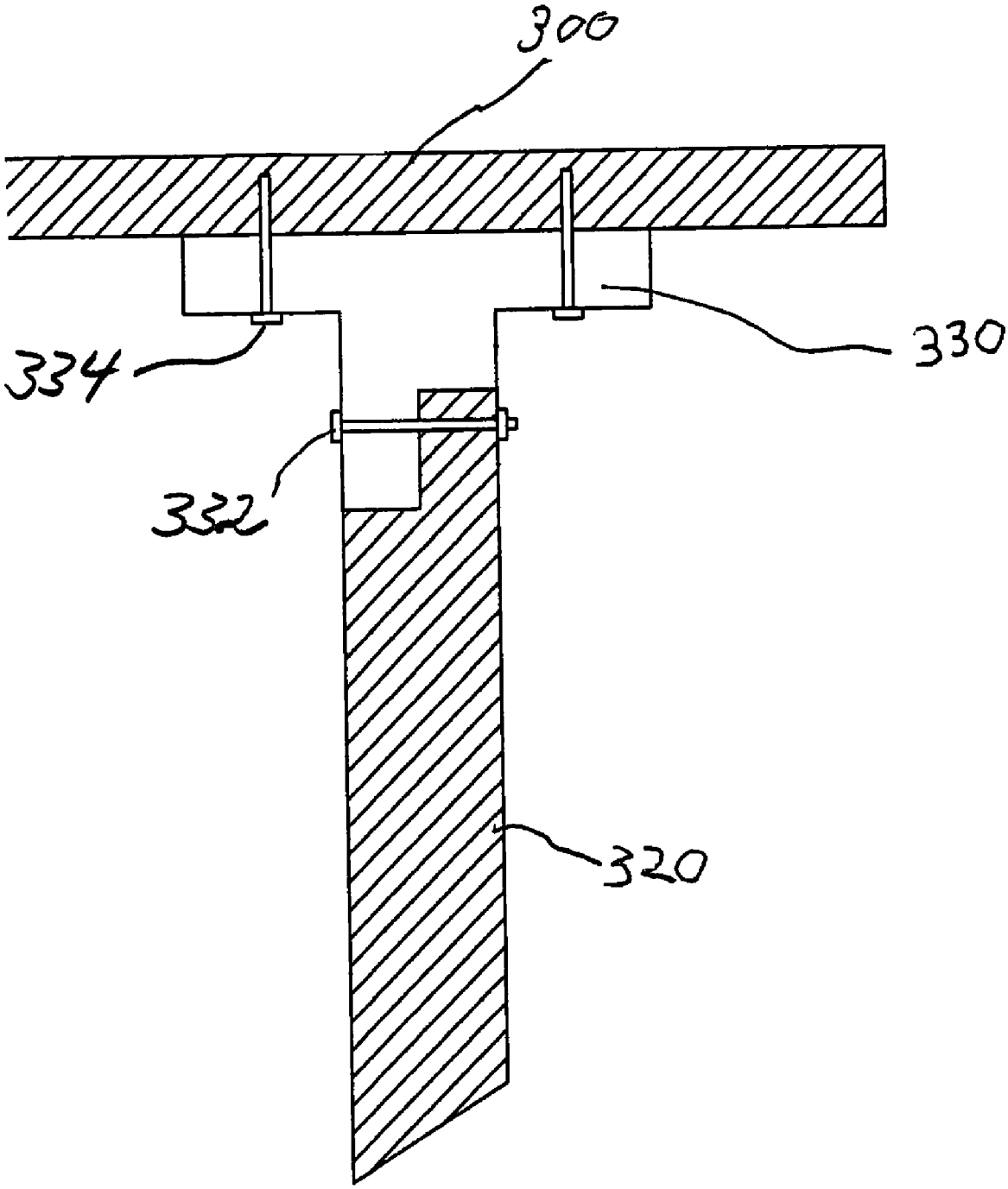
FIG. 18 is a top plan view of a bulkhead fastener with a rabbet connecting joint for a barrier wall according to the present invention.

As shown in FIGS. 17 and 18 respectively, a bulkhead fastener 331, 330 can optionally be used to tie a reinforcement wall 320 according to the present invention to an existing support structure 300. The bulkhead fastener 331, 330 is molded from truck tire crumb, and is used to make secure transitional connections between an end panel 320 and the existing structure 300 such as, for example, a steel sheet pile, a concrete structure such as a bridge support, or a bulkhead. The bulkhead fastener 331 and end panel 320 connecting joint can be, for example, a modified tongue and groove configuration, and the bulkhead fastener 330 and end panel 320 connecting joint can be, for example, a rabbet configuration. The bulkhead fastener 331, 330 is secured to existing structure 300 by a suitable fastener, such as, for example, a lag bolt 334. The end panel 320 is secured to the bulkhead fastener 331, 330 by a suitable fastener, such as, for example, a threaded bolt and nut assembly 332.

In a further embodiment of the present invention, the earthen containment reinforcement system 10 can include an electrical sensory system that detects and reports any potential breach in the reinforcement wall. The electrical sensory system is designed into each panel to pinpoint and report potential breaches in the reinforcement wall. The sensory system includes a sensor wire 80 (FIG. 4) and a hardwire, electromagnetic switch device extending through the top of each wall panel. More specifically, the system includes a device to detect a breach of the wall system, with the detecting device including a plurality of electromagnetic switches 81 housed within the conduit longitudinal PVC pipe 26 and connected to a monitor 82 configured to receive a signal from the switch. Any bending or buckling of the wall system will break the circuit and report the location of the failure to the monitor.

The foregoing is considered as illustrative only of the principles of the invention. Further, since numerous modifications and changes may readily occur to those skilled in the art, it is not desired to limit the invention to the exact construction and operation described and shown. Accordingly, all suitable modifications and equivalents may be resorted to that fall within the scope of the invention as defined by the following claims.

What is claimed is:

1. An earthen containment reinforcement system comprising: a plurality of base panels with an interconnecting top edge; a plurality of interconnected panels, each of the panels being configured to connect along a top edge and a bottom edge by a first joint, and along a first side edge and a second side edge by a second joint; a reinforcing cable extending from one end of the interconnected panels to another end thereof; a plurality of spaced anchors that support the interconnected panels by connecting to the reinforcing cable by a corresponding plurality of tether cables; and an erosion barrier connected to the top edge of each of a topmost panel of the interconnected panels, and extending away from the top of the interconnected panels toward a side of the earthen containment that is opposite a side in contact with water.

2. The system according to claim 1, wherein the plurality of interconnected panels are connected laterally.

3. The system according to claim 1, wherein the plurality of interconnected panels are connected laterally and vertically.

4. The system according to claim 1, wherein the panel includes a molded shell of mesh-sized tire crumb that houses alternating vertically-oriented layers of a tire bead reinforcing grid.

5. The system according to claim 4, wherein the tire bead reinforcing grid includes interconnected steel beads from used tire casings.

6. The system according to claim 4, wherein the molded shell is a watertight barrier that includes a hydraulically compressed and heated mixture of the tire crumb and a polyurethane binder.

7. The system according to claim 1, wherein the anchor is located below grade in a retained-water side of the earthen containment and has a partial spherical shape with a concave portion facing the reinforcing cable.

8. The system according to claim 1, wherein the anchor is a spoon anchor.

9. The system according to claim 1, wherein the tether cable extends diagonally downward through the earthen containment from the reinforcing cable to the anchor.

10. The system according to claim 1, wherein the panel includes a conduit that houses the reinforcing cable.

11. The system according to claim 10, further comprising a device to detect a breach of the system, the detecting device including a plurality of electromagnetic switches housed within the conduit and connected to a monitor configured to receive a signal from the switch.

12. The system according to claim 1, wherein the erosion barrier includes a plurality of traction ribs that promote adhesion to soil and a plurality of weep holes that provide for release of water.

13. The system according to claim 1, wherein the erosion barrier is a layer of connected half truck tires disposed on a layer of perforated fabric.

14. The system according to claim 1, wherein adjacent interconnected panels include a coating of adhesive along the joint at which the panels are connected.

15. The system according to claim 1, wherein the first joint and the second joint each have a configuration selected from the group consisting of a tongue and groove, a ball, and a rabbet.

16. The system according to claim 1, wherein the first joint has a tongue and groove configuration and the second joint has a rabbet configuration.

17. The system according to claim 1, wherein an outer surface of the panel includes a plurality of spaced recesses configured to promote adhesion of the panel to soil of the earthen containment.

18. The system according to claim 1, wherein the panel has a height of about 10 feet, a length of about 25 feet, and a depth of about 1 foot.

19. An earthen containment reinforcement system comprising: a plurality of base panels with an interconnecting top edge, the base panels being positioned in a bottom portion of the earthen containment and being constructed of recycled used vehicle tire material or recycled plastic material; a plurality of interconnected panels, each of the panels being configured to connect along a top edge and a bottom edge by a first joint, and along a first side edge and a second side edge by a second joint, and being constructed of recycled used vehicle tire material; a reinforcing cable extending from one end of the interconnected panels to another end thereof a plurality of spaced anchors that reinforce the interconnected panels by connecting to the reinforcing cable by a corresponding plurality of tether cables; and an erosion barrier connected to the top edge of each of a topmost panel of the interconnected panels and extending away from the top of the interconnected panels toward a side of the earthen containment that is opposite a side in contact with water, the erosion barrier being constructed of recycled used vehicle tire material.

20. The system according to claim 19, wherein the first and the second joints are reinforced by a water impervious adhesive.

* * * * *